United States Patent [19]

Reusser

[11] 4,337,606

[45] Jul. 6, 1982

[54] METAL PANEL AND MOUNTING STRUCTURE

[75] Inventor: Hans E. Reusser, Westlake, Ohio

[73] Assignee: Republic Steel Corporation, Cleveland, Ohio

[21] Appl. No.: 125,472

[22] Filed: Feb. 28, 1980

[51] Int. Cl.[3] ..... E04D 3/364

[52] U.S. Cl. ..... 52/520

[58] Field of Search ..... 52/522, 529, 536, 538, 52/542, 544, 518, 519, 520, 410, 478, 528, 588

[56] References Cited

U.S. PATENT DOCUMENTS

| | | | |
|---|---|---|---|
| 267,674 | 11/1882 | Comstock | 52/519 |
| 369,477 | 9/1887 | Smeeton | 52/520 |
| 3,131,794 | 5/1964 | Bender | 52/520 |
| 3,263,379 | 8/1966 | Cisco | 52/536 |
| 3,276,171 | 10/1966 | Brown | 52/588 |
| 3,312,028 | 4/1967 | Schroyer | 52/478 |
| 3,511,011 | 5/1970 | Straus | 52/478 |
| 3,525,189 | 8/1970 | Nelsson | 52/410 |
| 3,555,758 | 1/1971 | Schroter | 52/309.6 |
| 3,858,373 | 1/1975 | Day | 52/520 |
| 3,858,373 | 1/1975 | Day et al. | 52/713 |
| 3,898,373 | 8/1975 | Matlock et al. | 52/529 |
| 3,898,783 | 8/1975 | Matlock | 52/520 |
| 3,982,373 | 8/1976 | Wilson et al. | 52/588 |
| 3,998,019 | 12/1976 | Reinwall, Jr. | 52/478 |
| 4,102,105 | 7/1978 | Taylor et al. | 52/520 |
| 4,217,741 | 8/1980 | Cole | 52/543 |

*Primary Examiner*—John E. Murtagh

*Attorney, Agent, or Firm*—Emory L. Groff, Jr.

[57] ABSTRACT

Included in a panel assembly are panels each having opposite side walls terminating respectively in a standing fixed male seam and a standing deformable female seam. Similar ones of these panels are laterally joined to one another in a secure manner atop underlying support elements by mounting clips disposed intermediate juxtaposed side walls of adjacent panels. Assembly is achieved by sequentially inserting an uppermost flange on the mounting clips into a groove in the male seam of a first panel prior to rotating the clips downwardly juxtaposition the panel side wall and anchoring the clips to the support elements. Then a next panel is lowered with a downwardly facing cavity on its female seam overlying the first panel male seam, followed by roll-crimping of a portion of the uppermost female seam about the innermost male seam and mounting clip flange.

17 Claims, 8 Drawing Figures

METAL PANEL AND MOUNTING STRUCTURE

This invention relates generally, to building panels and manner of attachment and more specifically, to standing seam roof panels and associated mounting clips.

Numerous examples of standing seam roof panels and attachment means therefore have been produced in the past. Many of these known systems fall short of meeting certain advantages considered quite desirable in the building construction field. Foremost is that a secure seam be obtained between the assembled adjacent panels and preferably this is achieved without the formation of any exposed sharp bends or creases in either the panels or cooperating mounting devices. The components of the system should be constructed to allow of a rapid and simple assembly thereof and which results in a positive, secure interconnection. Advisably, this connection permits longitudinal movement between the components to accommodate thermal expansion and also includes means inhibiting the entrance of water due to capillary action. Of course, it is desirable that the panels themselves be constructed as economically as possible and accordingly, it is possible to employ a lighter gage of stock by providing a specific panel side wall configuration together with a panel bottom having an integral embossment therein to produce added stiffening thereto.

Accordingly, one of the objects of the present invention is to provide an improved metal panel and mounting structure including a mounting clip having an uppermost insert flange adapted to be inserted within a groove on a first side wall of one panel after which a deflectable flange on a second side wall of an adjacent panel is disposed in overlying engagement therewith prior to deformation of the deflectable flange to secure the two adjacent panels to one another.

A further object of the present invention is to provide an improved metal panel mounting structure including a plurality of adjacent panels each having a first side wall having an uppermost inwardly directed groove adapted to interlock with a mounting clip, and a second side wall provided with an outwardly and downwardly facing cavity adapted to overlie an adjacent panel already provided with one such mounting clip.

Still another object of the present invention is to provide an improved metal panel and mounting structure including a roof panel having a pair of upstanding side walls terminating respectively in a fixed male seam and a deformable female seam and disposed on either side of a panel bottom provided with a continuous serpentine stiffening bead.

With these and other objects in view which will more readily appear as the nature of the invention is better understood, the invention consists in the novel construction, combination and arrangement of parts hereinafter more fully described, illustrated and claimed.

Similar reference characters designate corresponding parts throughout the several figures of the drawings.

Figure 1:
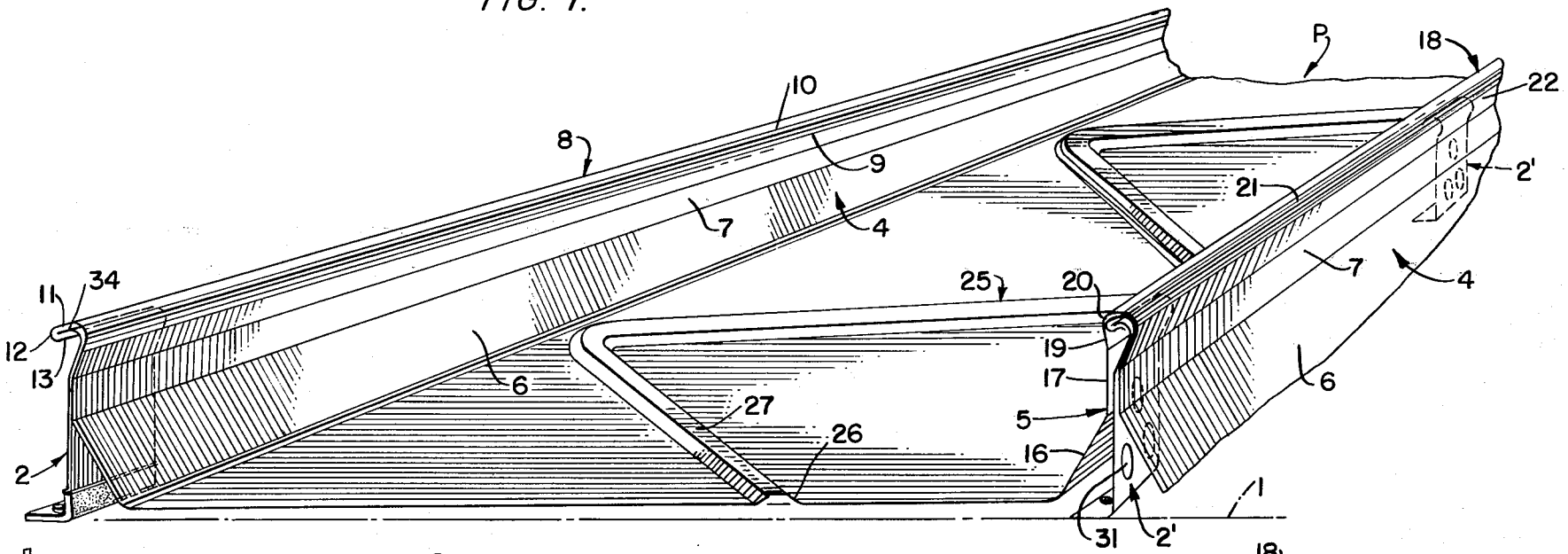
FIG. 1 is a fragmentary top perspective view illustrating a metal panel and mounting structure according to the present invention.
Figure 2:
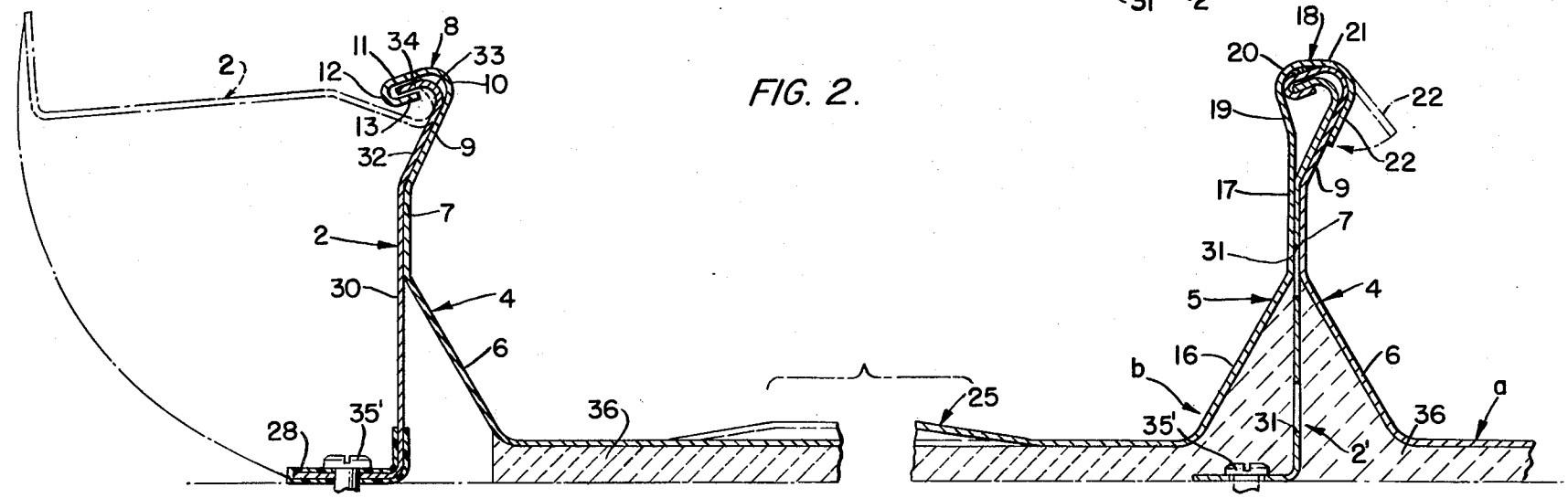
FIG. 2 is a vertical sectional view illustrating the sequence of assembly of the components of the invention.
Figure 3:
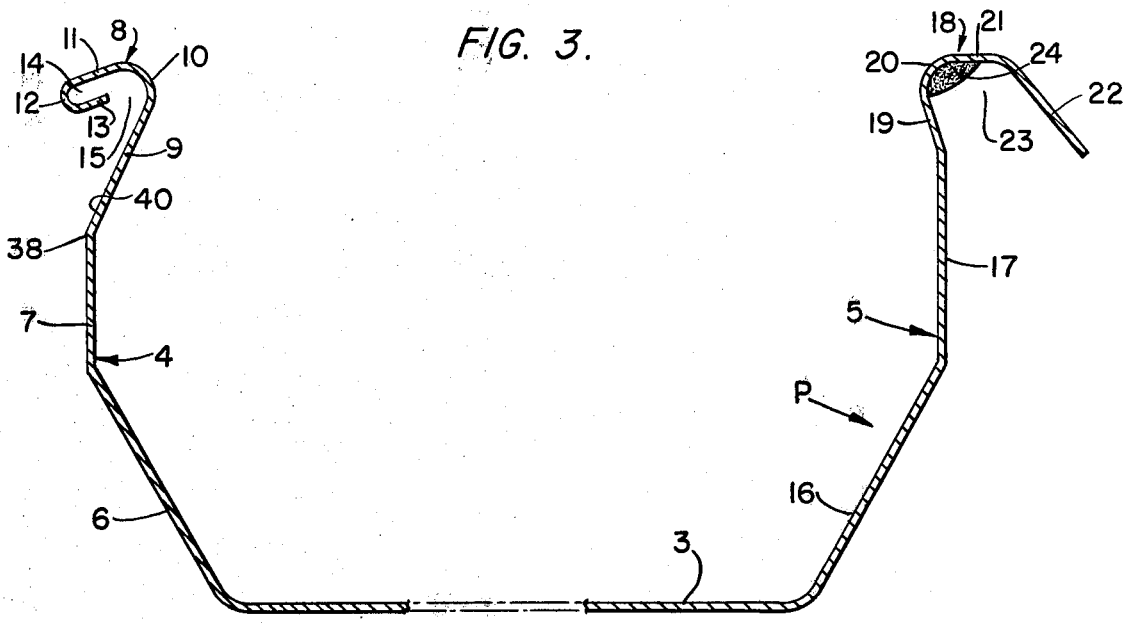
FIG. 3 is a vertical end sectional view of one roof panel.

Referring now to the drawings, particularly FIGS. 1 and 2, the present invention will be seen to comprise a plurality of adjacently assembled roof panels a,b disposed atop any suitable number of transversely disposed purlins or supports 1 and fixedly retained thereupon by means of a plurality of mounting clips 2 or 2'. Each of the panels a,b, etc. forming an assembly of sequentially installed panels will be understood to be of identical construction and the cross sectional configuration of these panels will most readily be appreciated upon review of FIG. 3 of the drawings wherein it will be seen that each said panel P includes a bottom 3 joined respectively to a longitudinally extending first side wall 4 and second side wall 5.

The first panel side wall 4 comprises an outwardly inclined section 6 joined to the vertical section 7 which in turn is connected to a fixed male seam or edge generally designated 8 and which is formed by the inwardly directed or inclined section 9, rolled portion 10, top portion 11, outer nose portion 12 and inwardly facing flange 13. The flange 13 will be seen to be disposed substantially parallel and spaced from the top portion 11 such that an inwardly directed groove 14 is formed therebeteen while the distal portion of the flange 13 stops well short of the opposed rolled portion 10 so as to provide an outwardly facing clip-receiving cavity 15 therebetween.

The second panel side wall 5 comprises an outwardly inclined section 16 joined to the vertical section 17 which in turn is connected to a deformable female seam or edge 18 formed by the inwardly directed or inclined section 19, rolled portion 20, top portion 21 and downwardly directed deflectable or deformable flange 22. The distal portion of the flange 22 will be seen to be disposed so as to form a divergent angle with respect to the inwardly inclined section 19 and the reason for this construction, as well as the fact that the overall height of the second side wall 5 is slightly greater than that of the first side wall 4, will become obvious hereinafter.

Figure 4:
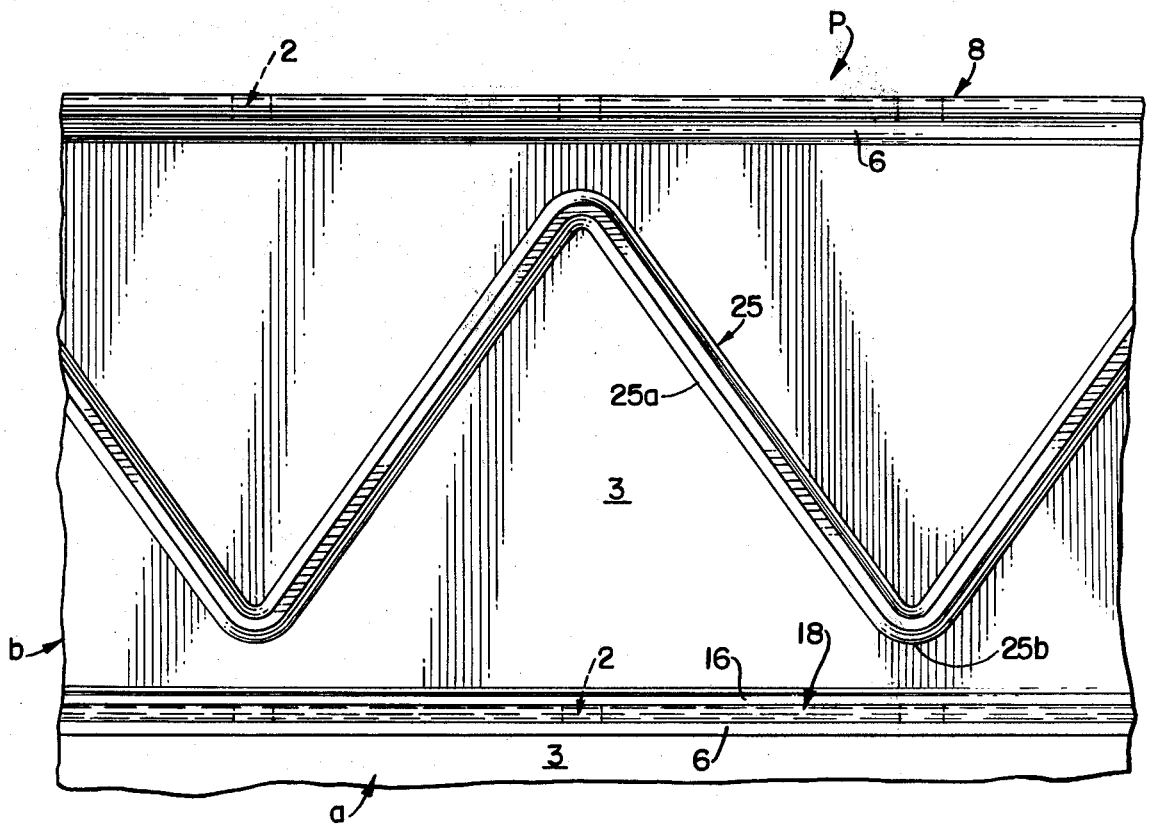
FIG. 4 is a fragmentary top plan view of the panel.

Two other important features of the panels P may now also be described. The opening defined by the spaced apart deflectable flange 22 and inwardly directed section 19 forms an outwardly and downwardly facing cavity 23, the base of which will be seen to be provided with a sealant bead 24 which is intended to cooperate with a nested male seam 8 of an adjacent panel P to provide an assembled water-proof seam. As shown in FIGS. 1, 2 and 4 of the drawings, the bottom 3 of each panel is constructed with an integral elevated stiffening bead or embossment 25 which preferably comprises a continuous or endless serpentine deformation of the panel bottom and includes a pair of upwardly inclined side walls 26–26 joined by a planar top wall 27. Quite obviously, during the initial fabrication of the panel stock it would be most practical to form the bead 25 throughout the running extent of the panels yet following cutting of the panels into individual lengths it will be apparent that one end thereof should have a portion of this bead 25 reflattened to provide an underlap.

In addition to providing desirable strength to the panels, the serpentine bead or deformation 25 enhances the drain-off of water atop the panels. FIG. 4 most clearly illustrates the inclined disposition of each diagonal portion 25*a* and the smooth radii at each rounded end portion 25*b*. This arrangement encourages an improved drain-off even in a very low pitched roof installation, contrary to the lesser run-off which could be expected with other forms of stiffening, such as transverse ribbing.

Figure 8:
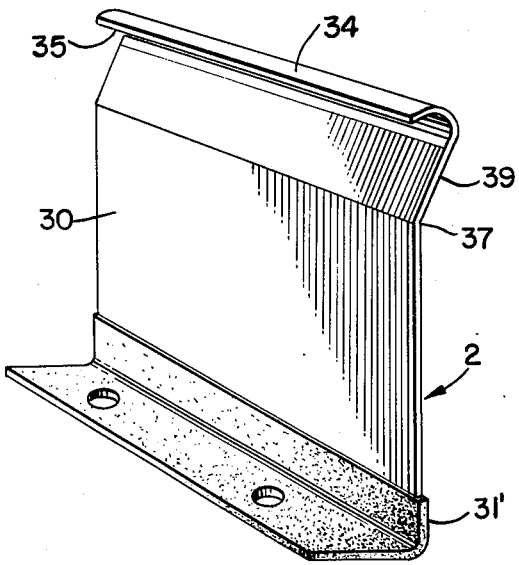
FIG. 8 is a perspective view of an alternate form of the mounting clips.
Figure 5:
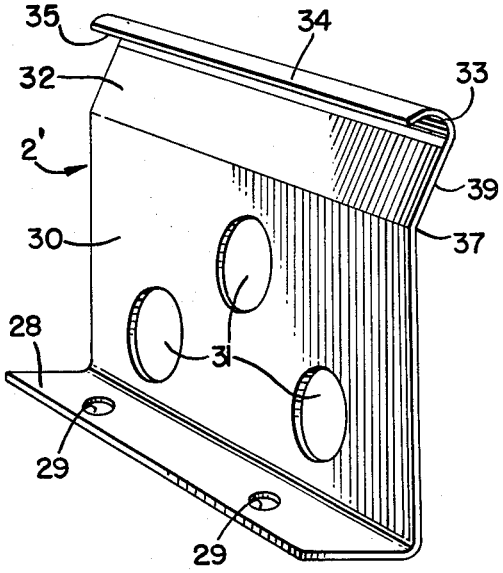
FIG. 5 is a perspective view of one form of the mounting clips.

The construction of the fixed seam 8 and deformable seam 18 is intended to cooperate with an intermediate mounting clip 2 or 2' shown most clearly in FIGS. 5 and 8 of the drawings. The two clips are of substantially similar construction and either one may be employed in any one installation. The interchangeability of the two clips will be readily apparent from a review of FIGS. 1 and 2 wherein clip 2 is shown in the left-hand portion while clip 2' is illustrated in the right-hand portion of those Figures. A description of either clip will suffice to explain the configuration of both clips with any distinctions between the two being noted hereinafter.

Each clip includes an outwardly facing base or attachment foot 28 provided with a pair of anchor holes 29-29 and is joined to an upstanding or vertical web 30 which, in the case of clip 2' is provided with a plurality of apertures 31 intended to provide means reducing thermal conduction between subsequently joined panels and the underlying purlins or supports. In the case of the clip 2, this thermal break is provided by means of a resilient plastic coating 31' encapsulating the base 28 and extending upwardly to surround the adjacent lower portion of the web 30.

Connected to the top of the clip vertical web 30 is an offset upper section 32 joined to a rolled portion 33 which in turn terminates in a downwardly and outwardly directed panel insert flange 34 forming the uppermost component of the clip. The diverging flange 34 and upper section 32 form a downwardly facing groove 35 therebetween.

Having described the specific structure of the various components of the invention, the manner of assembly thereof may now be discussed. The sequence of assembly of adjacent panels and the intermediate clips 2 or 2' may best be followed from a review of FIGS. 1 and 2 of the drawings. Assembly of the panels P progresses from the right to the left with panel a initially being disposed atop the transverse purlins 1. Thereafter, two or more of the mounting clips 2 are engaged with the left-hand or first panel side wall 4 of the panel a by disposing the insert flange 34 of the clip within the clip receiving cavity 15 of the male seam 8 and thence swinging the thus inserted clip downwardly from a horizontal position to a vertical position such as indicated in the left-hand portion of FIG. 2 of the drawings. During the aforementioned movement, it will be understood that as the clip is swung downwardly the distal portion of the panel insert flange 34 is displaced into the groove 14 of the side wall 4 of the panel a and when the clip is vertically disposed, the insert flange 34 of the clip will be substantially parallel between the opposed flange 13 and top portion 11 of the panel side wall 4. When thusly displaced, the outwardly facing base 28 of each of the clips are secured to the underlying purlins by the application of appropriate fasteners 35' through the clip anchor holes 29.

Two points can be brought forth at this time. FIG. 2 of the drawings illustrate a filler or body of compressed insulation 36 disposed between the underside of the panels P and the supporting purlins 1 and this feature will be most desirable from the standpoint of both sound and thermal absorption. Quite obviously, specifications for different installations will call for various amounts or thicknesses of insulation 36 and any such variance is readily accommodated merely by providing mounting clips having vertical webs 30 of different heights with respect to the undersurface of the clip base 28. For any one set of specifications the distance between the juncture line 37 and the bottom of the base 28 of the clip will be selected to coincide with the height of the juncture line 38 at the top of the panel side wall vertical section 7 to ensure the mating engagement as shown most clearly in the right hand portion of FIG. 2 wherein it will be seen that the juncture lines 37–38 coincide while the outer face 39 of the clip upper section 32 flushly engages the outer face 40 of the panel side wall inwardly directed section 9.

Following the installation of a suitable number of clips 2 or 2' juxtaposed the first side wall 4 of the right hand panel a, the next adjacent panel b is assembled therewith. This latter assembly step merely comprises lowering the panel b with its second side wall 5 being moved downwardly to juxtaposition its vertical section 17 with the vertical web 30 of the mounting clips. During this downward movement of the panel b the female seam 18 is lowered over the male seam 8 of the previously installed panel a with the entire male seam being disposed within the cavity 23 of the female seam 18. The assembled components will then appear as shown in the right hand portion of FIG. 2 with the deflectable flange 22 in the position denoted by the broken lines. Thereafter, the assembly of the juxtaposed seams 8 and 18 is completed by roll-crimping the flange 22 downwardly and inwardly to the full line position as shown in the right hand portion of FIG. 2 thereby fully encapsulating the male seam 8 within the confines of the female seam 18 such that a secure locking of the two adjacent panel side walls 4 and 5 is achieved together with the mounting clip 2 sandwiched therebetween.

During this final assembly of adjacent panel side walls it will be understood that the compliant sealant bead 24 is deformed as the female seam 18 is deflected about the male seam 8 such that a substantially waterproof seal is attained between the two nested seams. The assembly of additional panels continues following the same sequence until the entire lateral extent of the roof is covered by the required number of panels P.

Figure 6:
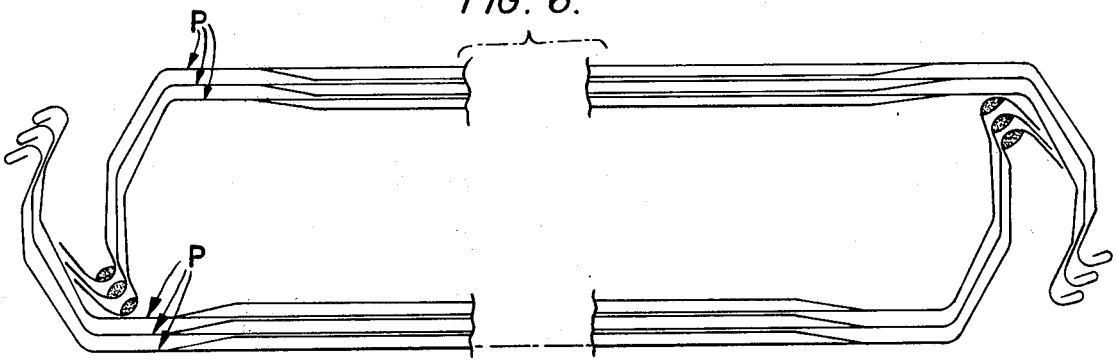
FIG. 6 is an end elevation of a plurality of nested panels.
Figure 7:
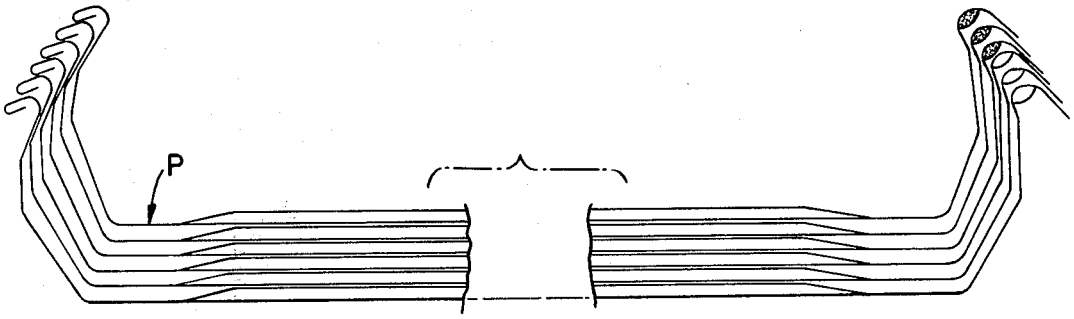
FIG. 7 is an end elevation of an alternate manner of nesting the roof panels.

The above construction of the panels P lends itself to economical storage and efficient handling of a plurality of panels prior to installation thereof. FIGS. 6 and 7 of the drawings illustrate two arrangements whereby a plurality of the panels may be nested in a very compact manner resulting in an extremely low profile and thus conducive to efficient storage and convenient handling as a unit.

I claim:

1. A standing seam panel assembly including, a plurality of adjacently connected panels disposed atop supporting means, said panels each having a bottom joined to opposite first and second side walls, said first side wall having an uppermost fixed male seam and said second side wall having an uppermost female seam, said male seam provided with a top portion extending away from its respective said panel first side wall and joined to a nose portion in turn connected to an inwardly facing flange, said nose portion projecting outward from its respective said panel first side wall, said top portion and flange spaced apart to define an inwardly directed groove therebetween, each said male seam including a substantially straight upwardly and inwardly inclined section extending above said first side wall, said female seam provided with an outwardly extending top portion joined to a downwardly directed deformable flange defining an outwardly and downwardly facing cavity therebeneath, said female seam top portion and flange extending away from their respective said panel second side wall, a mounting clip disposed intermediate said first and second panel side walls of said adjacently connected panels and said female seam of one said panel adapted to overlie said male seam of another one said panel without significant relative pivotal displacement between said adjacently disposed panels whereby, said overlying deformable flange may be crimped downwardly into engagement with said male seam upwardly and inwardly inclined section to securely retain said male seam within said female seam cavity and provide a laterally and vertically locked panel assembly seam resulting in the interconnection of adjacent ones of said panels.

2. A standing seam panel assembly according to claim 1 including, a bead of compliant sealant deposited within said female seam cavity engageable with said male seam top portion during said interconnection of adjacent panels.

3. A standing seam panel assembly according to claim 1 wherein, each said panel bottom includes an elevated stiffening embossment extending longitudinally substantially the length of said panel and extending laterally the majority of the width of said panel.

4. A standing seam panel assembly according to claim 3 wherein, said embossment comprises a bead provided with a pair of upwardly inclined side walls joined to an intermediate planar top wall.

5. A standing seam panel assembly according to claim 3 wherein, said embossment includes a plurality of beads disposed substantially diagonally along said panel bottom.

6. A standing seam panel assembly according to claim 1 including, an insulating filler disposed intermediate said panel bottom and said supporting means.

7. A standing seam panel assembly according to claim 1 wherein, said panel first and second side walls each include an outwardly inclined section extending upwardly from said panel bottom and each joined to a vertical section.

8. A standing seam panel assembly according to claim 1 wherein, said panel first and second side walls each include a medially disposed vertical section, said female seam including an inwardly inclined section extending upwardly from its respective vertical section and both said male and female seams provided with a rolled portion joining said respective inwardly directed sections and said respective top portions.

9. A standing seam panel assembly according to claim 8 wherein, said deflectable flange when crimped downwardly flushly engages said inwardly inclined section of said adjacent panel first side wall and is displaced through an arc of less than 90°.

10. A standing seam panel assembly according to claim 3 wherein, said embossment comprises a continuous serpentine bead.

11. A standing seam panel assembly according to claim 1 wherein, said mounting clip includes a base adapted to be anchored relative said supporting means, an uppermost panel insert flange on said clip extending downwardly and outwardly and said insert flange insertable within said male seam inwardly directed groove prior to the overlying of an adjacent panel female seam.

12. A standing seam panel assembly according to claim 1 wherein, said mounting clip includes a base adapted to be anchored relative said supporting means, a vertical web extending upwardly from said base, an upper section offset from said web, a rolled portion joined to said upper section and an uppermost panel insert flange extending downwardly and outwardly from said rolled portion whereby, said insert flange is insertable within said male seam inwardly directed groove prior to the overlying of an adjacent panel female seam.

13. A standing seam panel assembly according to claim 12 wherein, said clip web includes a plurality of apertures therein.

14. A standing seam panel assembly according to claim 13 wherein, said clip rolled portion is disposed adjacent said panel first side wall rolled portion.

15. A standing seam panel assembly according to claim 11 wherein, said mounting clip resists lateral and vertical displacement of said adjacent interconnected panels relative said clip while allowing longitudinal displacement of said panels relative said clip.

16. A standing seam panel assembly according to claim 12 including, a resilient plastic coating surrounding said clip base.

17. A standing seam panel assembly according to claim 1 wherein, said panel first and second side walls each include a medially disposed vertical section, said female seam including an inwardly inclined section extending upwardly from said second side wall vertical section and both said male and female seams provided with a rolled portion joining said respective inwardly inclined sections and said respective top portions, said mounting clip including a base adapted to be anchored relative said supporting means, a vertical web extending upwardly from said base, an upper section offset from said web, a rolled portion joined to said clip upper section, an uppermost panel insert flange extending downwardly and outwardly from said clip rolled portion whereby, said insert flange is insertable within said male seam inwardly directed groove prior to the overlying of an adjacent panel female seam, at least a portion of said clip web flushly sandwiched between said medially disposed vertical sections of said interconnected adjacent first and second panel side walls, and said clip upper section flushly engaging said adjacent first side wall inwardly inclined section.

* * * * *